US008113790B2

(12) United States Patent
Williams et al.

(10) Patent No.: US 8,113,790 B2
(45) Date of Patent: Feb. 14, 2012

(54) PUMP ASSEMBLY

(75) Inventors: David John Williams, Hatton Park (GB); David Black, Brimingham (GB); Raymond Martin Johnson, Birmingham (GB); Christopher Sadler, Tamworth (GB); Tim P. Buttery, Halesowen (GB)

(73) Assignee: Pierburg Pump Technology UK Limited (GB)

( * ) Notice: Subject to any disclaimer, the term of this patent is extended or adjusted under 35 U.S.C. 154(b) by 720 days.

(21) Appl. No.: 11/220,831

(22) Filed: Sep. 7, 2005

(65) Prior Publication Data

US 2006/0057006 A1 Mar. 16, 2006

(30) Foreign Application Priority Data

Sep. 14, 2004 (GB) ..... 0420410.3

(51) Int. Cl.
*F04B 43/12* (2006.01)

(52) U.S. Cl. ..... 417/53; 417/420; 417/423.1

(58) Field of Classification Search ..... 417/423.1, 417/420, 53

See application file for complete search history.

(56) References Cited

U.S. PATENT DOCUMENTS

| | | | | |
|---|---|---|---|---|
| 3,220,350 | A | 11/1965 | White | |
| 3,280,750 | A | 10/1966 | White | |
| 4,226,574 | A | 10/1980 | Villette | |
| 4,465,437 | A | 8/1984 | Jensen et al. | |
| 4,752,194 | A | 6/1988 | Wienen et al. | |
| 4,958,988 | A | 9/1990 | Regev | |
| 4,998,863 | A | 3/1991 | Klaus | |
| 5,785,013 | A * | 7/1998 | Sinn et al. | 123/41.44 |
| 5,831,364 | A | 11/1998 | Buse | |
| 5,915,931 | A | 6/1999 | Lindner et al. | |
| 6,036,456 | A * | 3/2000 | Peters et al. | 417/423.3 |
| 6,264,440 | B1 * | 7/2001 | Klein et al. | 417/420 |
| 6,293,769 | B1 * | 9/2001 | Radermacher et al. | 417/357 |
| 6,293,772 | B1 * | 9/2001 | Brown et al. | 417/420 |
| 6,363,918 | B2 * | 4/2002 | H.ang.kansson et al. | 123/509 |

(Continued)

FOREIGN PATENT DOCUMENTS

| | | |
|---|---|---|
| DE | 25 29 399 A1 | 1/1977 |
| EP | 1 335 135 | 8/2003 |

(Continued)

OTHER PUBLICATIONS

Search Report in corresponding United Kingdom Patent Application GB 0420410.3 issued Nov. 18, 2004.

*Primary Examiner* — Devon C Kramer
*Assistant Examiner* — Peter J Bertheaud
(74) *Attorney, Agent, or Firm* — Dykema Gossett PLLC

(57) ABSTRACT

A pump assembly including a pumping element mounted for rotation within a pump chamber, movement of the pumping element in the chamber causing pumping of fluid within the pump chamber, and a motor, the motor including a stator and a rotor which is connected to the pumping element such that activation of the motor causes movement of the pumping element and hence pumping of fluid within the pump chamber, there being a sealing assembly which permits fluid in the pumping chamber to flow around the rotor but which substantially prevents fluid from the pumping chamber from contacting the stator, the sealing assembly including a partition part which lies between the stator and the pumping chamber and a sealing part which lies between the stator and the rotor, wherein the sealing part is made from a polymeric material over-molded onto the partition part.

13 Claims, 10 Drawing Sheets

U.S. PATENT DOCUMENTS 7,101,158 B2 * 9/2006 Hembree et al. ..... 417/420

FOREIGN PATENT DOCUMENTS

JP 10-311290 11/1998
JP 2000-14110 1/2000
JP 2002-357192 12/2002
JP 2003-83277 3/2003
JP 2003-222095 8/2003

* cited by examiner

PUMP ASSEMBLY

This application claims priority to United Kingdom Patent Application No. 0420410.3 filed Sep. 14, 2005, the entire disclosure of which is incorporated herein by reference.

FIELD OF THE INVENTION

The present invention relates to a pump assembly, particularly, but not exclusively, to a water pump and brushless DC motor assembly for use in an automotive vehicle.

DESCRIPTION OF THE PRIOR ART

When designing a pump assembly for use in an automotive vehicle, for example for pumping coolant such as water around an internal combustion engine, there are various factors to be taken into consideration. Space in the engine compartment of an automotive vehicle is limited, and therefore it is desirable to provide a pump assembly which is as compact as possible. Moreover, as an electric motor generates heat when in use, where the pump is driven by an electric motor, it is desirable to provide some means of cooling the motor. It is known to cool the motor using pumped fluid, but in this case, it is preferable that steps are taken to ensure that the pumped fluid cannot cause corrosion of the motor. Finally, it is desirable to minimise the cost of manufacturing the pump assembly by producing a pump assembly that has a reduced number of component parts which are quick and easy to assemble.

SUMMARY OF THE INVENTION

According to a first aspect of the invention we provide a pump assembly including a pumping element mounted for rotation within a pump chamber, movement of the pumping element in the chamber causing pumping of fluid within the pump chamber, and a motor, the motor including a stator and a rotor which is connected to the pumping element such that activation of the motor causes movement of the pumping element and hence pumping of fluid within the pump chamber, there being a sealing assembly which permits fluid in the pumping chamber to flow around the rotor but which substantially prevents fluid from the pumping chamber from contacting the stator, the sealing assembly including a partition part which lies between the stator and the pumping chamber and a sealing part which lies between the stator and the rotor, wherein the sealing part is made from a polymeric material over-moulded onto the partition part.

By virtue of over-moulding the sealing part onto the partition part, a one piece sealing assembly may be manufactured relatively simply and inexpensively, a substantially fluid tight seal may readily be provided between the sealing part and the partition part, and the sealing part and partition part may be made from different materials. Making the sealing part from a polymeric material particularly advantageous as such a material has minimal effect on the magnetic fields between the motor rotor and stator, and thus is not significantly detrimental to the performance of the motor.

Preferably the partition plate is metallic. Thus, an electronic motor controller may be mounted on the partition part, and the partition part may act as a sink for heat generated by the motor controller. The partition part may, for example be made from cast aluminium.

The rotor may extend through an aperture provided in the partition part to the pumping element, and the partition part may further include a generally tubular attachment portion which extends from around the aperture axially of the rotor, the sealing part being over-moulded onto the attachment portion.

In this case, a free end of the attachment portion may be provided with a plurality of axially extending castellations. During the over-moulding process, the polymer from which the sealing part is moulded is forced around the castellations, and thus the castellations assist in preventing radial movement of the sealing part relative to the attachment portion and improving the seal between these two parts.

The attachment portion may additionally or alternatively be provided with at least one circumferential groove. During the over-moulding process, the polymer from which the sealing part is moulded is forced into the groove, and thus the groove assists in preventing axial movement of the sealing part relative to the attachment portion and improving the seal between these two parts.

The rotor may be mounted on a shaft for rotation about the shaft, and the sealing part may also be over-moulded around the shaft.

Thus, three separate components of the pump assembly may be combined into a single piece, and thus, manufacture and assembly of the pump assembly simplified further.

The shaft may be provided with a circumferential groove. Thus, during the over-moulding process, the polymer from which the sealing part is moulded is forced into the groove, and thus the groove assists in preventing axial movement of the sealing part relative to the shaft and improving the seal between these two parts.

The sealing part may be made from PPS.

According to a second aspect of the invention we provide a method of making a pump assembly including a pumping element mounted for rotation within a pump chamber, movement of the pumping element in the chamber causing pumping of fluid within the pump chamber, and a motor, the motor including a stator and a rotor which is connected to the pumping element such that activation of the motor causes movement of the pumping element and hence pumping of fluid within the pump chamber, there being a sealing assembly which permits fluid in the pumping chamber to flow around the rotor but which substantially prevents fluid from the pumping chamber from contacting the stator, the sealing assembly including a partition part which lies between the stator and the pumping chamber and a sealing part which lies between the stator and the rotor, wherein the method includes the step of overmoulding the sealing part onto the partition part.

DESCRIPTION OF THE DRAWINGS

An embodiment of the invention will now be described, by way of example only, with reference to the accompanying figures, of which.

DESCRIPTION OF THE PREFERRED EMBODIMENTS OF THE INVENTION

Figure 1:
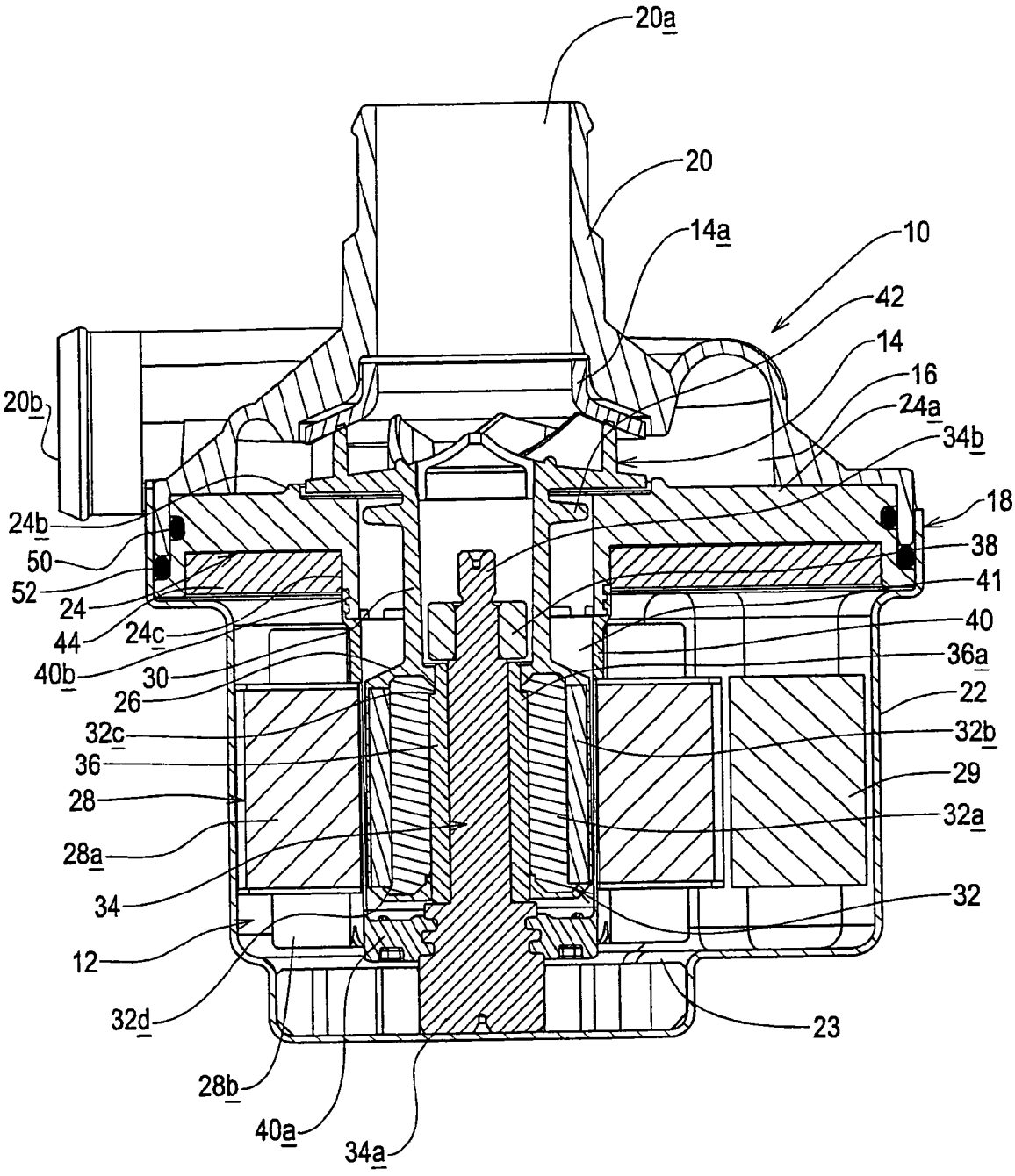
FIG. 1 is an illustrative cross-sectional view through a pump assembly according to the invention.
Figure 2:
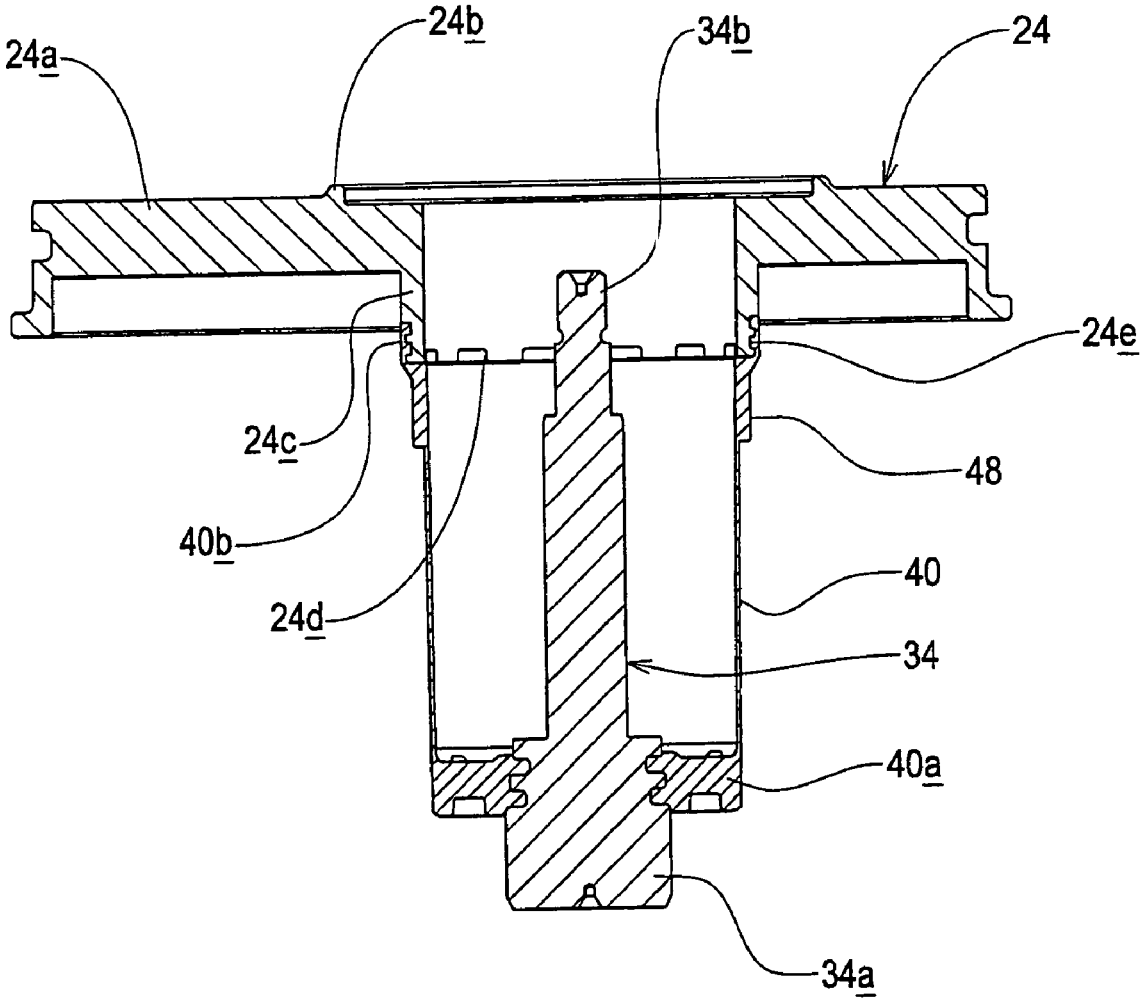
FIG. 2 is an illustrative cross-sectional view through the sealing assembly, i.e. partition plate, sealing part and static shaft of the pump assembly of FIG. 1.
Figure 3:
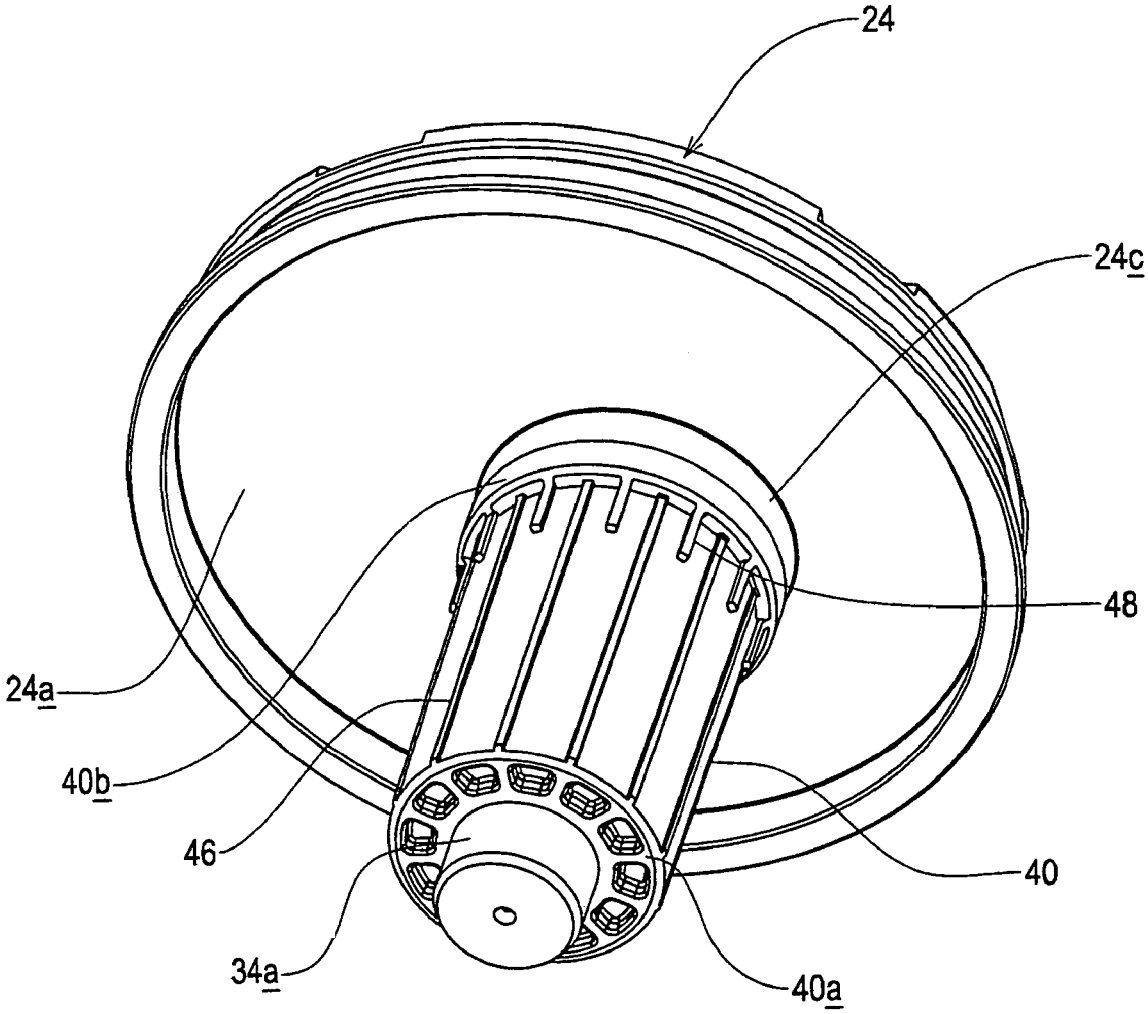
FIG. 3 is an illustrative perspective view of the sealing assembly of FIG. 2.
Figure 4:
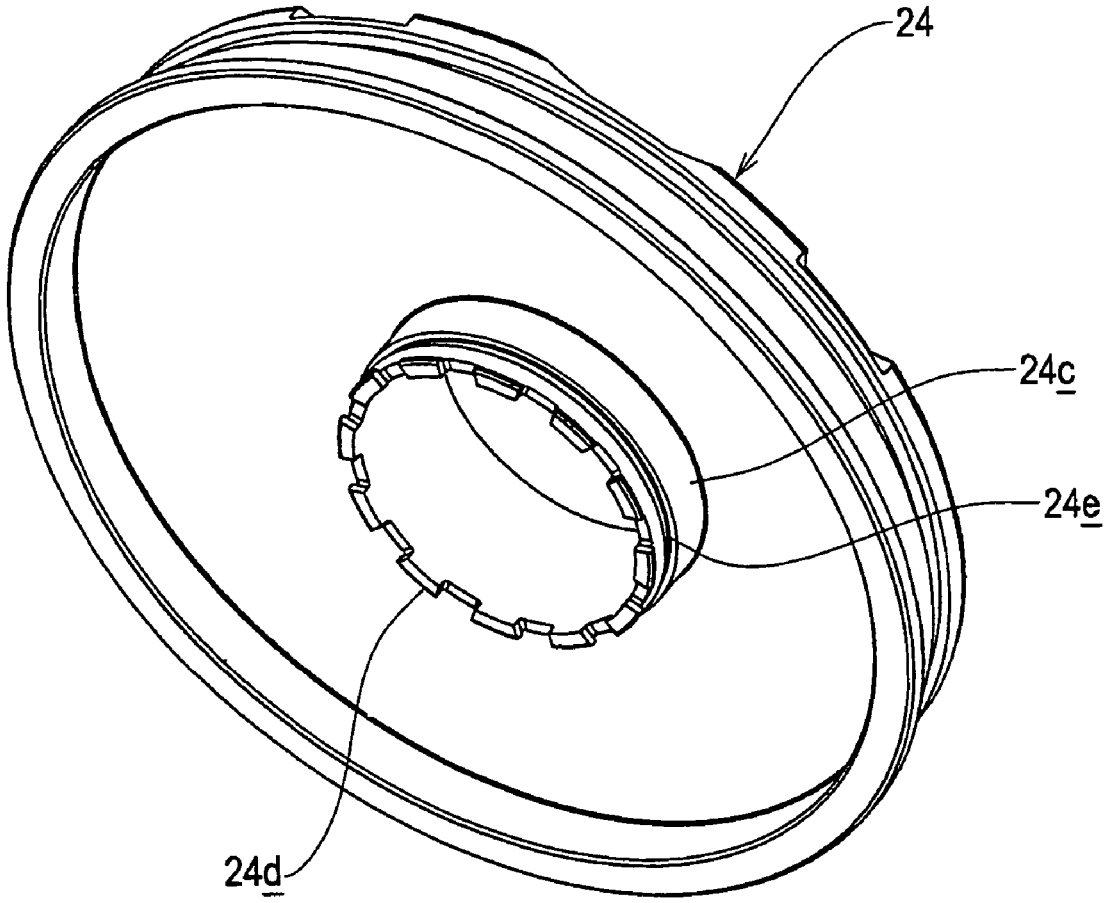
FIG. 4 is an illustrative perspective view of the partition plate of the pump assembly of FIG. 1 from below.
Figure 5:
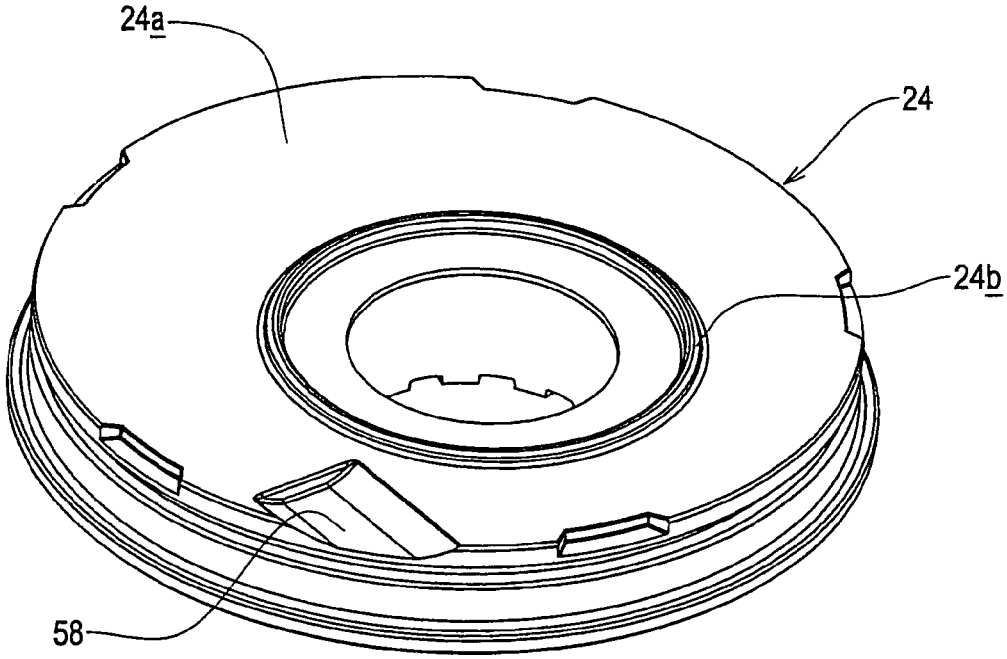
FIG. 5 is an illustrative perspective view of the partition plate of the pump assembly of FIG. 1 from above.
Figure 6:
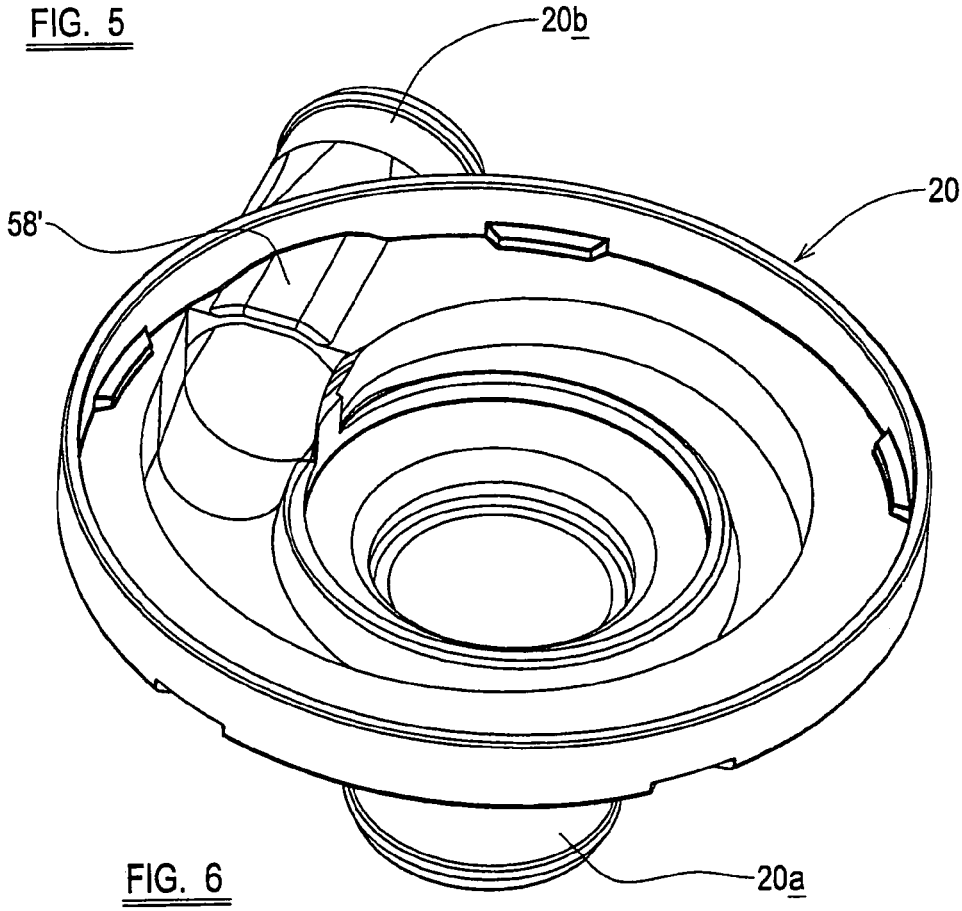
FIG. 6 is an illustrative perspective view of the volute of the pump assembly of FIG. 1 from below.
Figure 7:
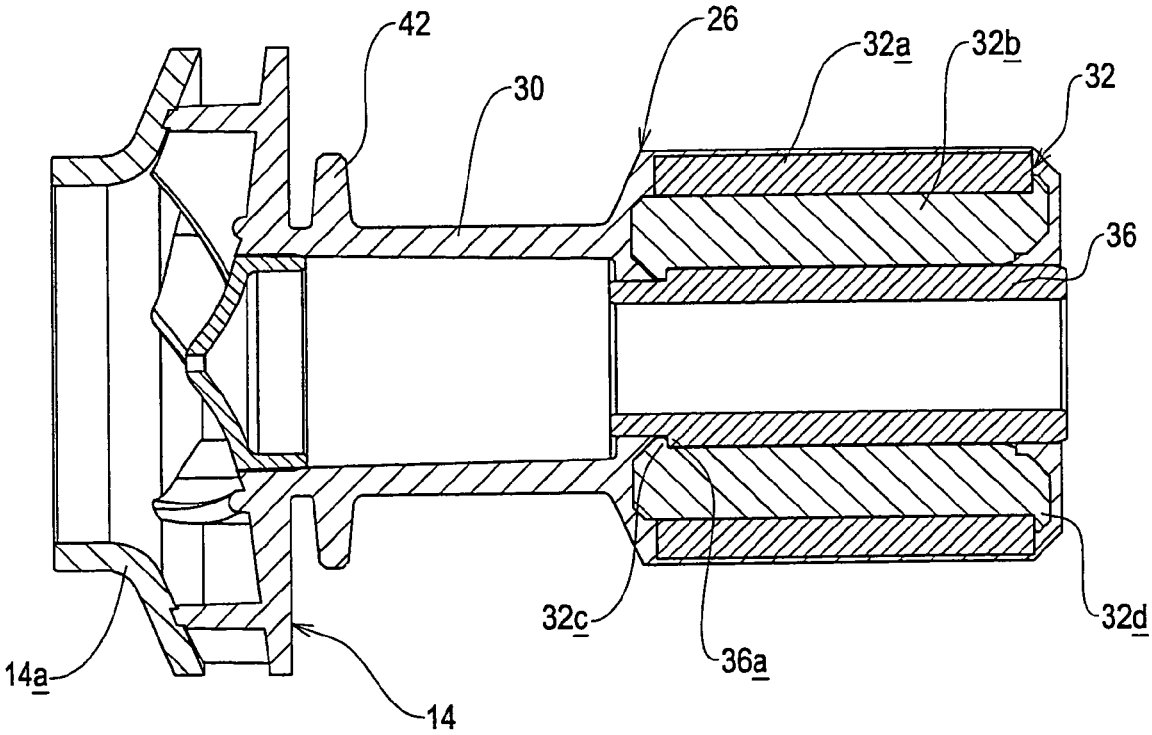
FIG. 7 is an illustrative longitudinal cross-sectional view through the pumping element and rotor of the pump assembly of FIG. 1.
Figure 8:
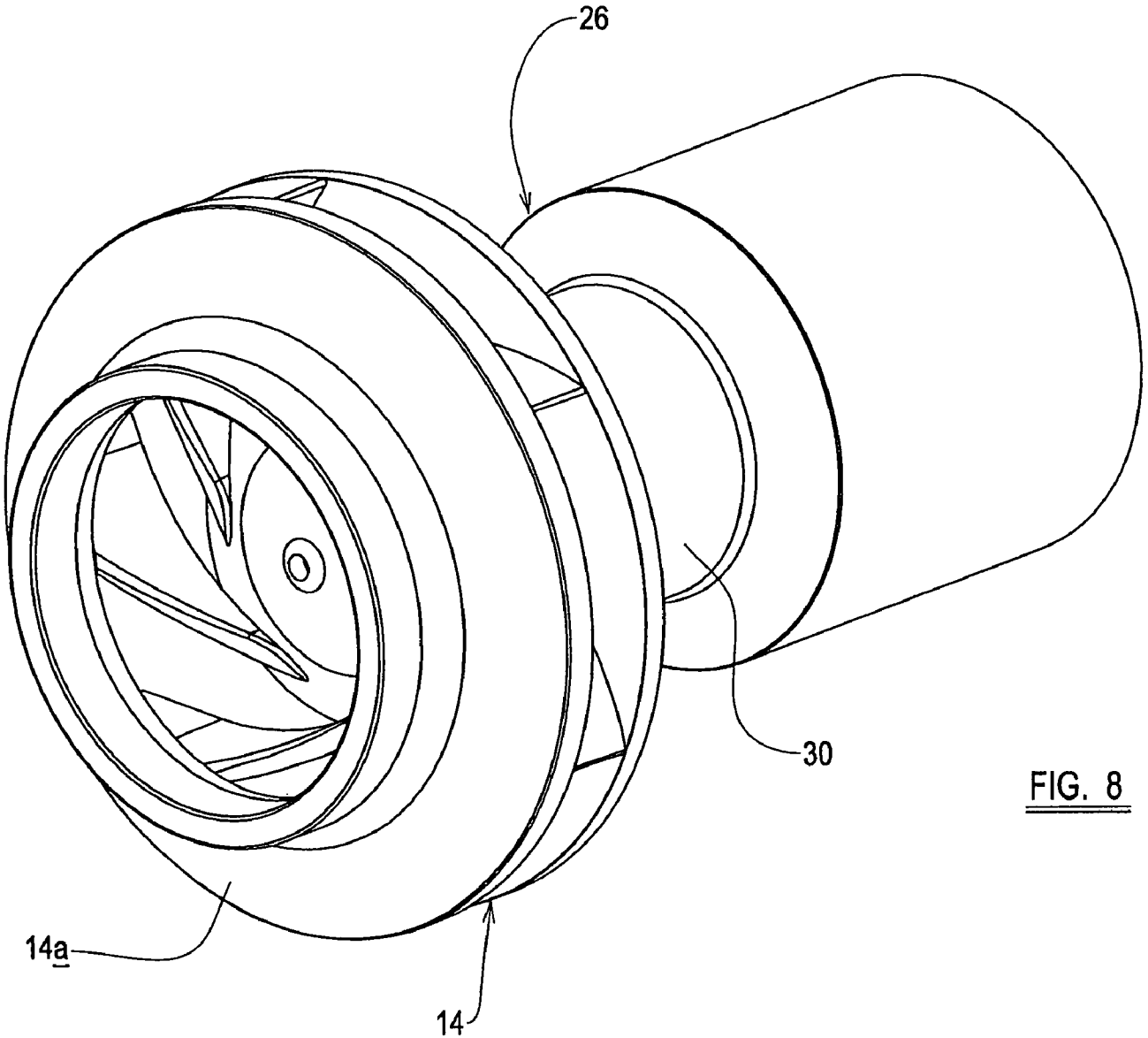
FIG. 8 is an illustrative perspective view of the pumping element and rotor of FIG. 7.
Figure 9:
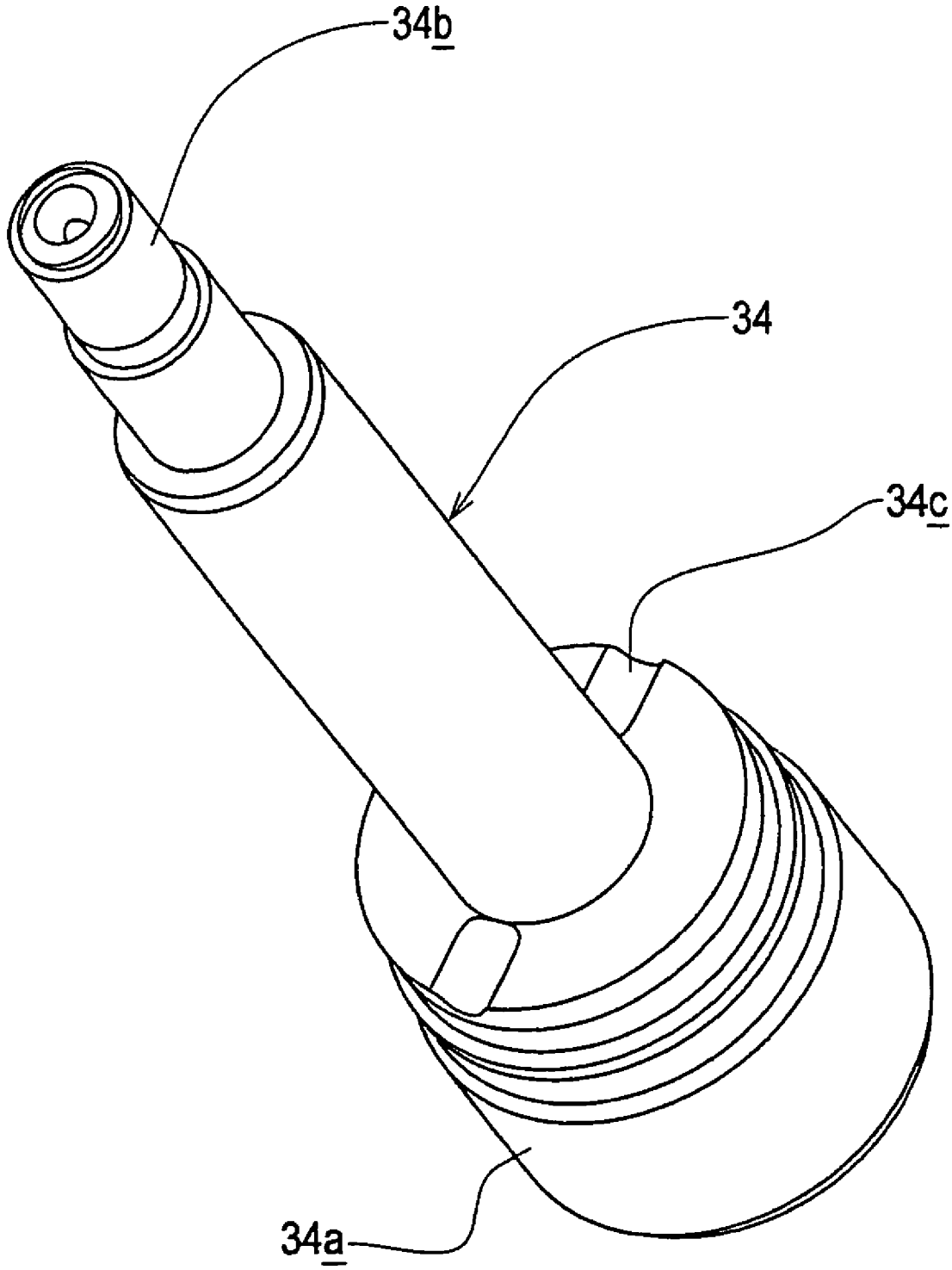
FIG. 9 is an illustrative perspective view of the shaft of the pump assembly of FIG. 1.
Figure 10:
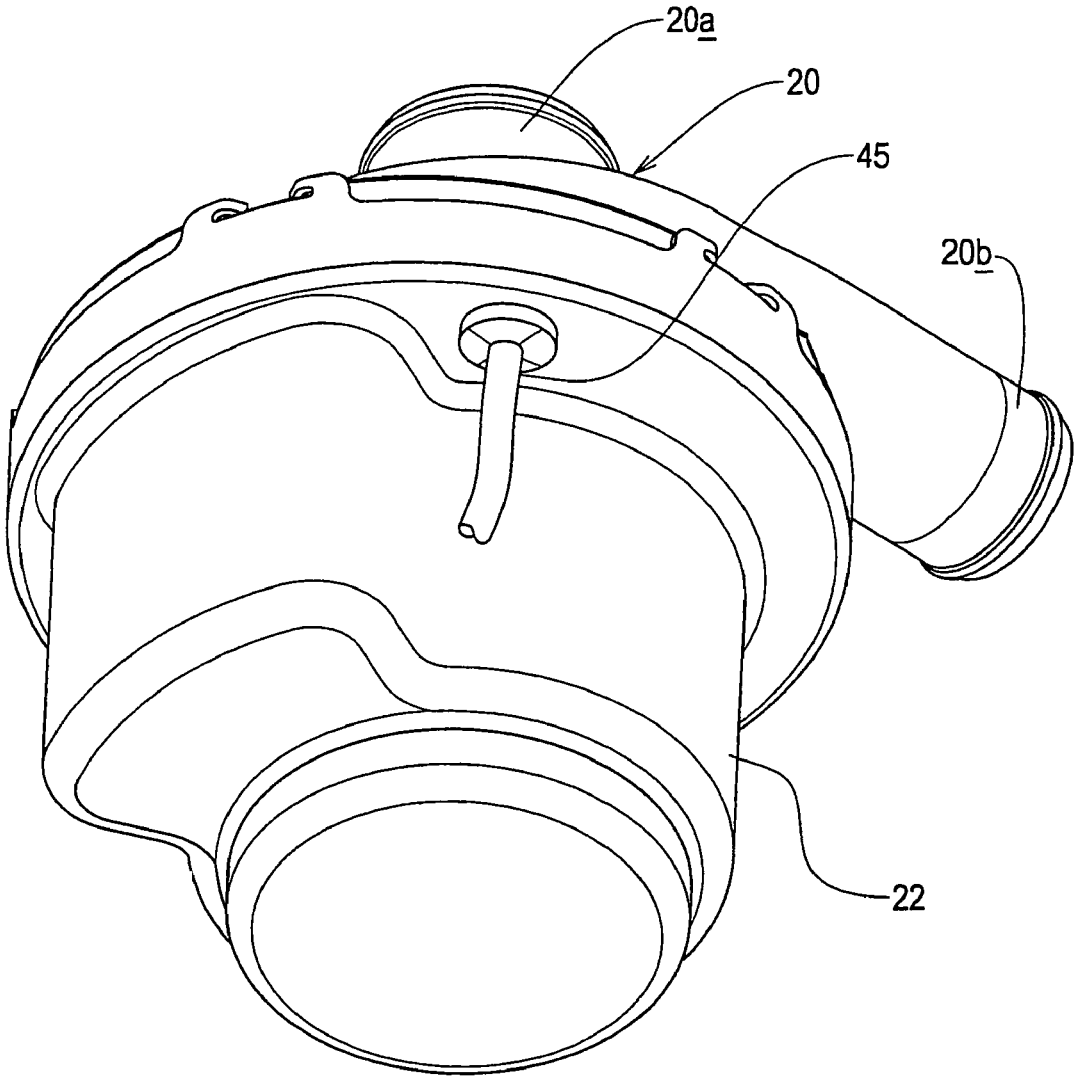
FIG. 10 is an illustrative perspective view of the pump assembly of FIG. 1 viewed from below.
Figure 11:
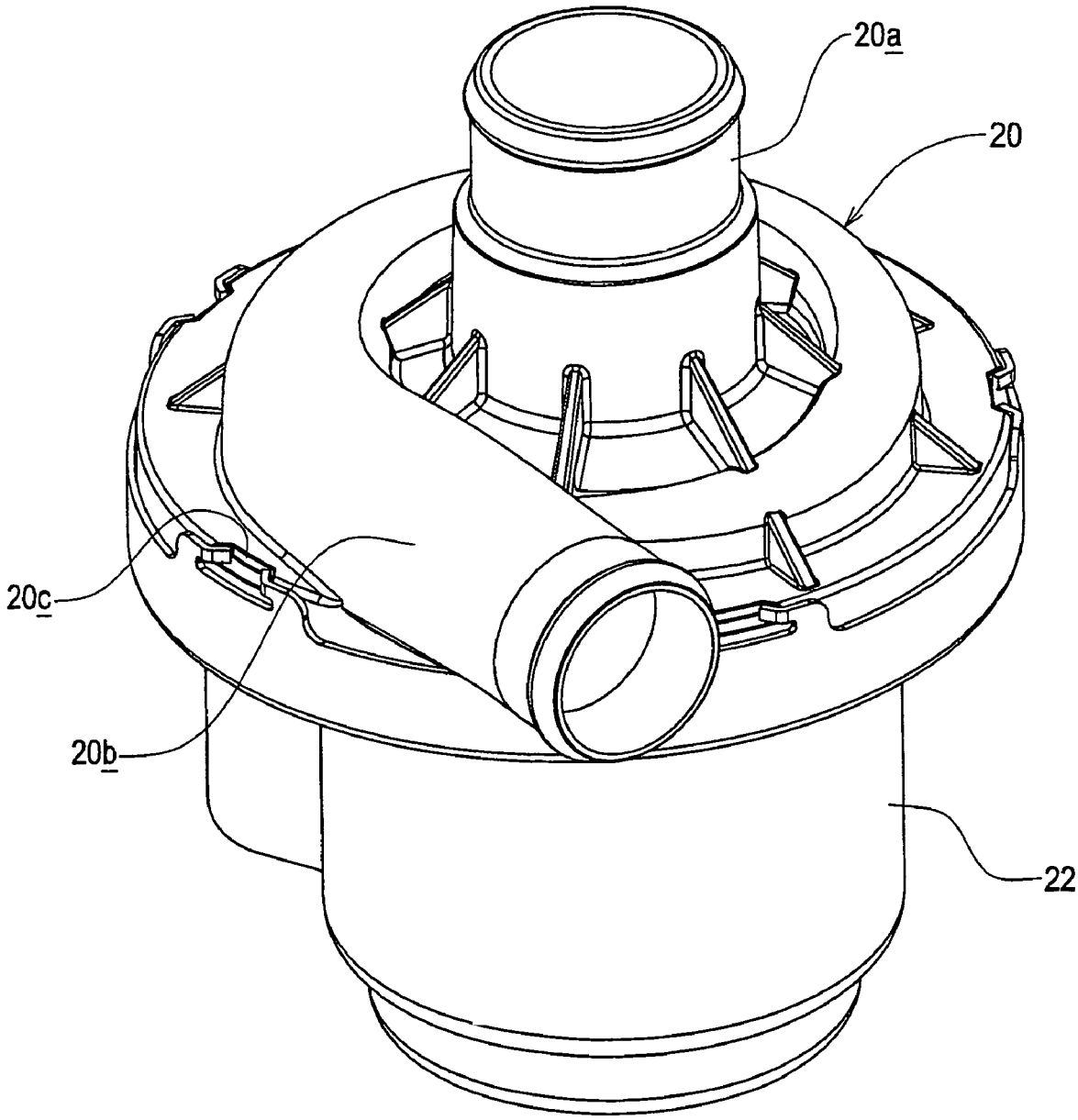
FIG. 11 is an illustrative perspective view of the pump assembly of FIG. 1 viewed from above.

Referring now to the figures, there is shown a pump assembly 10 including a motor 12 and a pumping element 14, in this example a pump impeller, which is mounted for rotation in a pump chamber 16, rotation of the impeller causing pumping of fluid in the pump chamber 16. The impeller 14 is of conventional configuration, and is provided with a top cap 14*a* which includes a nose portion which has an axially extending wall which encloses a generally cylindrical space. The pump assembly 10 also includes a pump housing 18 which has two parts, namely a volute 20 which encloses the impeller 14 and a motor housing 22 which encloses the motor 12. A generally circular partition plate 24 is provided to separate the volume enclosed by the volute 20 from the volume enclosed by the motor housing 22, the pump chamber thus being enclosed by the partition plate 24 and the volute 20. The volute 20 is of conventional configuration and includes an inlet 20*a* which extends along the axis of rotation of the impeller 14, and an outlet 20*b* which extends generally radially of the impeller 14. Both the inlet 20*a* and outlet 20*b* have a generally circular cross-section, and to reduce energy losses in fluid passing from the pump chamber 16 into the outlet 20*b* as a result of the transition from an open chamber into a cylindrical tube, a recess 58 is provided in the surface of the partition plate 24 adjacent the outlet 20*b* into which a corresponding formation 58' of the pump volute 20, which extends the generally circular cross-section of the outlet 20*b* into the volute, fits in use.

The motor 12 includes a rotor 26 and stator 28, both of which are mounted in the motor housing 22. The rotor 26 is connected to and coaxial with the impeller 14 such that activation of the motor 12 causes rotation of the impeller 14 in the pump chamber 16, and hence pumping of fluid in the pump chamber 16.

The rotor 26 includes a magnet assembly 32 and generally cylindrical connecting portion 30 which connects the magnet assembly 32 and the impeller 14 and which extends through an aperture in the partition plate 24 to the impeller 14. The magnet assembly 32 includes a plurality of magnets 32*a* which are arranged around the rotor 26 orientated axially with respect to the rotor 26, and a cylindrical iron yoke 32*b* around an exterior surface of which the magnets 32*a* arranged.

The rotor 26 is supported on a static shaft 34 which extends axially along and generally centrally of the rotor 26. A first end 34*a* of the shaft 34 has a larger diameter than the remainder of the shaft 34, and the end portion is retained in an aperture provided in a stiffener plate 23 which is mounted the motor housing 22, whilst a second end 34*b* of the shaft 34 extends into the connecting portion 30 of the rotor 26. The stiffener plate 23 is made from steel, and assists to prevent deformation of the housing 18 under the forces exerted by the pumped fluid on the rotor 26. The shaft 34 is received in an aperture in the stiffener plate 23 in an interference fit, and the stiffener plate 23 is also engaged with the motor housing 22 in an interference fit.

The rotor 26 is provided with a bearing 36 which is mounted on an interior surface of the iron yoke 32*b* and which engages with the smaller diameter portion of the shaft 34 to support the rotor 26 whilst permitting rotation of the rotor 26 about the shaft 34. As the first end 34*a* has a larger diameter than the remainder of the shaft 34, and the bearing 36 is engaged with the smaller diameter portion of the shaft 34, the larger diameter portion 34*a* supports the bearing and ensures that the bearing 36 cannot move axially downwardly relative to the shaft 34. A collar part 38 is mounted around the second end 34*b* of the shaft 34 and engages with the shaft 34 in an interference fit and with the bearing 36 to further restrict axial movement of the rotor 26 with respect to the shaft 34. Mounting the rotor 26 on a static shaft 34 on a single bearing 36 ensures that frictional losses between the rotor 26 and the shaft 34 are minimised and that the rotor 26 has relatively low inertia.

The stator 28 is of conventional construction and includes a plurality of cores made from a magnetizable material around with are wound coils of an electrically conductive wire.

There is a gap between the connecting portion 30 of the rotor and the partition plate 24 so that a portion of the high pressure fluid within the pump chamber 16 is driven into the motor housing 22 around the rotor 26 and thus assists in cooling the motor 12 and bearing 36 and lubricating the bearing 36.

In this example, the diameter of the aperture in the partition plate 24 through which the connecting portion 30 of the rotor 26 extends is significantly larger than the outer diameter of the connecting portion 30. The connecting portion 30 is, however, provided with a radially outwardly extending fin formation 42 which is of substantially the same thickness as the connecting portion 30 and which locally increases the diameter of the connecting portion 30 within the aperture in the partition plate 24 to substantially the same diameter as the nose portion of the impeller top cap 14*a*. Configuring the fin formation 42 such that the diameter of the fin formation 42 is approximately equal to the outer diameter of the nose portion of the impeller top cap 14*a*, ensures that the axial forces exerted by the high pressure fluid in the pump chamber 16 are balanced, and therefore there is no net axial thrust exerted on the impeller 14.

High pressure fluid within the pump chamber 16 will flow both towards the inlet 20*a* through the gap between the volute 20 and the impeller nose portion and into the motor housing 22.

A generally circular ridge formation 24*b* extends from the partition plate 24 around the impeller 14. Flow of fluid from the pump chamber 16 into the motor housing 22 is thus dictated by the spacing of the impeller 14 from the ridge 24*b* and the partition plate 24 and the spacing of the fin formation 42 from the partition plate 24, which are typically of the order of 0.5 mm.

Two grooves 34*c* are provided in the radially outwardly extending surface of the shaft 34 between the larger diameter first end 34*a* and the adjacent smaller diameter portion of the shaft 34, on which the bearing 36 is supported. The two grooves 34*c* extend radially outwardly of the shaft 34, and rotation of the bearing 36 around the shaft 34 causes fluid in the rotor chamber 41 to be drawn along the grooves 34*c* radially inwardly of the shaft 34, between the shaft 34 and the bearing 36 to cool and lubricate the bearing, over the second end 34*b* of the shaft 34 and back into the pump chamber 16 via a central aperture in the impeller 14.

A sealing part 40, which, in this example, comprises a tube wall enclosing a generally cylindrical space hereinafter referred to as the rotor chamber 41, is mounted around the rotor 26, between the rotor 26 and the stator 28 to prevent fluid from the pump chamber 16 from coming into contact with the stator 28. The sealing part 40 is provided at a first end with a radially inwardly extending closure formation 40*a* which engages with the shaft 34 between the bearing 36 and the first end 34*a* of the shaft 34. An opposite end 40*b* of the sealing part 40 engages with a generally tubular attachment portion 24*c* of the partition plate 24. The attachment portion 24*c* extends from the edge of the aperture in the partition plate 24 towards the magnet assembly 32 enclosing a generally cylindrical space.

The motor 12 is a brushless D.C. motor, and operation of the motor 12 is controlled by an electronic control unit (ECU) 44. Power is supplied to the ECU 44 via electrical connectors 45 which are mounted on the exterior of the motor housing 22, and in this example, an electrical filter 29 for filtering the electrical current to the ECU 44 is mounted in the motor housing 22 adjacent the stator 28. As the stator 28 is of a smaller diameter than the diameter of the partition plate 24, the motor housing 22 includes a larger diameter portion which is mounted around the partition plate 24, and a smaller diameter portion which encloses the stator 28 and electrical filter 29. The electrical connectors 45 may thus be mounted on the portion of the motor housing 22 which extends generally parallel to the partition plate 24 between the larger diameter portion and the smaller diameter portion, in order to maintain a compact pump assembly 10 configuration.

The ECU 44 is mounted on the partition plate 24 on the motor housing 22 side of the plate 24 around the aperture through which the rotor 26 extends. Thus, the electronic components that comprise the ECU 44 are arranged in a generally annular array around the rotor 26. The partition plate 24 is made from cast aluminium, and acts as a heat sink for heat generated by the ECU 44, and is cooled by fluid within the pump chamber 16. Moreover, mounting the ECU 44 within the pump housing 18 on the partition plate 24 may assist in reducing the overall volume of the pump assembly 10.

In this embodiment of the invention, the volute 20 is asymmetric, and the inlet 20*a* does not extend centrally of the volute 20. As the inlet 20*a* extends coaxially with the impeller 14 and hence also the motor rotor 26, it will be appreciated that the impeller 14 and rotor 26 also do not extend centrally of the pump housing 18. Similarly, the aperture through the partition plate 24 is not located centrally of the partition plate 24, and there is a larger area 24*a* of partition plate 24 on one side of the aperture.

By virtue of this asymmetrical arrangement, the main heat generating electronic components of the ECU 44 may be concentrated on the larger area 24*a* of the partition plate 24. The outlet 20*b* from the volute 20 is located above this larger area 24*a* of the partition plate 24, and thus the area of the partition plate 24 supporting these heat generating electronic components of the ECU 44 is cooled by high pressure fluid at the pump outlet. This arrangement may further assist in cooling the ECU 44.

Cooling of the ECU 44 may be further improved by providing features on the surface of the partition plate 24 adjacent the outlet 20*b* which induce turbulence in fluid passing to the outlet 20*b*. Such features could be a plurality of ridges.

The method of manufacturing the pump assembly 10 will now be described.

In this example, the rotor 26 and impeller 14 are integrally constructed as a one-piece rotor assembly by injection moulding of a polymer around the magnet assembly 32 and bearing 36. The bearing 36 is mounted in a mould cavity, one end of the bearing 36 engaged with a tool such that the bearing 36 is supported within the mould cavity.

The magnets 32*a* are mounted around the iron yoke 32*b* and glued in place. The iron yoke 32*b* includes a radially outwardly extending shoulder formation 32*d* on its exterior surface, and when the magnets 32*a* are located in the desired position relative to the iron yoke 32*b*, the magnets 32*a* engage with the shoulder formation 32*d*, and thus further movement of the magnets 32*a* relative to the iron yoke 32*b* is restricted and the likelihood of the magnets 32*a* slipping relative to the iron yoke 32*b* during the moulding process is reduced.

The iron yoke 32*b* is then placed around the bearing 36. The bearing 36 is also provided with a radially outwardly extending shoulder formation 36*a* on its exterior surface, and the iron yoke 32*b* is provided with a corresponding shoulder formation 32*c* on its interior surface. The shoulder formations 36*a*, 32*c* are located such that they engage when the iron yoke 32*b* is in the desired position relative to the bearing 36, the shoulder formations 36*a*, 32*c* thus restricting further movement of the iron yoke 32*b* relative to the bearing 36, and hence reducing the possibility of the iron yoke 32*b* slipping relative to the bearing 36 during the moulding process.

The magnets 32*a* are then placed around the iron yoke 32*b*.

By virtue of the provision of the shoulder formations 36*a*, 32*c*, 32*d* there is no need to provide separate tools to support the magnets 32*a* and iron yoke 32*b* in the mould cavity during the moulding process, and hence manufacture of the rotor 26 is simplified.

Fabricating a one piece rotor 26 and impeller 14 by over moulding material ensures that, providing the bearing 36 is correctly located on the appropriate tool during the moulding process, there will be concentricity of the impeller 14, rotor 26 and bearing 36, and that the magnets 32*a* and iron yoke 32*b* are completely sealed from contact with fluid in the rotor chamber 41, and therefore corrosion of the magnets 32*a* and iron yoke 32*b* is substantially prevented. This also simplifies construction of the rotor 26 as no fasteners are required to retain the magnets 32*a*, iron yoke 32*b* and bearing 36 on the rotor 26.

To enhance the sealing of the magnets 32*a* and iron yoke 32*b*, at each end of the iron yoke 32*b* there is a step in the interior surface of the iron yoke 32*b* which extends around the entire circumference of the interior surface, such that end portions of the interior surface of the iron yoke 32*b* are spaced from the bearing 36. Thus, during moulding of the polymeric portion of the rotor 26, molten polymer is forced into and fills these spaces, and further assists in sealing the magnets 32*a* and iron yoke 32*b* from fluid in the rotor chamber 41.

The partition plate 24 is made by pressure die-casting an appropriate aluminium alloy. As the partition plate 24 is in contact with fluid within the pump chamber 16, if the pump is used to pump a fluid which is corrosive to aluminium, for example if the pump is used in fuel cell applications, then it is necessary to apply a corrosion resistant coating to the surfaces in contact with pumped fluid. Such a corrosion resistant coating may be applied by electroless nickel plating for example. Rather than applying a corrosion resistant coating, it is, of course, possible to make the partition plate 24 from a corrosion resistant material such as stainless steel, but a stainless steel partition plate 24 would not only increase the cost and weight of the pump assembly, but would also not provide such an effective heat sink as an aluminium partition plate 24. The partition plate 24 may alternatively be made from a polymeric material.

The static shaft in this example is machined from stainless steel bar, but may be made from any other appropriate material, such as a ceramic, or polymer.

Whilst the sealing part 40 could be integral with the partition plate 24, in order to provide an effective heat sink, the partition plate 24 is preferably metallic. The sealing part 40 is preferably made from a polymer, however, as such a material would have minimal effect on the magnetic fields between the rotor 26 and the stator 28. Moreover, it is desirable to minimise the gap between the rotor 26 and stator 28, and thus the sealing part 40 should be as thin as possible. In contrast, a thicker partition plate 24 is required to provide structural integrity and to act as an effective heat sink, and moulding a component with such variation in section thickness can be problematic. Thus, in this example, the sealing part 40 is not integrally formed with the partition plate 24, but is, instead, made by injection moulding a polymeric material around the partition plate 24 and the shaft 34 to form a one piece sealing can assembly. The partition plate 24 and shaft 34 are located in mould tools which hold the parts in position in the mould cavity during the injection moulding process, and the sealing part 40 is then overmoulded around the attachment portion 24*c* of the partition plate 24 and the shaft 34. In this example, the sealing part 40 is made from 0.5 mm thick PPS. The sealing part 40 may, however, be made from any other appropriate polymer, e.g. PPA.

Overmoulding the sealing part 40 ensures that a substantially fluid tight seal is provided between the sealing part 40 and the partition plate 24 and shaft 34, and thus leakage of fluid from the rotor chamber 41 into the remainder of the motor housing 22 is substantially prevented.

To enhance the sealing between the sealing part 40 and the shaft 34, the shaft 34 is provided with two circumferential grooves. During injection moulding of the sealing part 40, molten polymer flows into and fills these grooves, and thus, the grooves not only ensure that there is mechanical locking of the shaft 34 relative to the sealing part 40, but that there is a substantially fluid tight seal between these two parts. Whilst in this example the sealing part 40 is overmoulded around the shaft 34, the shaft may, instead be integral with the sealing part 40.

To enhance the sealing between the sealing part 40 and the partition plate 24, the attachment portion 24*c* is provided with axially extending castellations 24*d* at the free end thereof, and an exterior surface of the attachment 24*c* is provided with two circumferential grooves 24*e*. During overmoulding of the sealing part 40, molten polymer flows into and fills the grooves 24*e* and the spaces of the castellations 24*d*, and when the polymer sets, this provides mechanical locking of the sealing part 40 relative to the partition plate 24, and may assist in improving the seal between the partition plate 24 and the sealing part 40. The use of both axial castellations 24*d* and radial grooves 24*e* ensures that differential thermal expansion of the polymeric sealing part 40 and metallic partition plate 40 can be accommodated and a good seal provided over a wide range of temperatures and pressures.

The volute 20 is made from injection moulded PPS, and the motor housing 22 is made by deep drawing steel sheet to a thickness of 1.2 mm. Provision of a metallic motor housing 22 ensures that heat from the stator 28 may be lost through the motor housing 22.

The pump assembly 10 is then assembled by first mounting the ECU 44 on the partition plate 24. The cast partition plate 24 is provided with mounting features for attachment of the ECU 44. Such features may, for example be axially extending pins which pass through appropriate apertures in the ECU 44 and which are then deformed to retain the ECU 44 on the partition plate 24. The use of integral mounting features simplifies assembly of the pump assembly 10 as separate fasteners are not required.

The stator 28 is then located around the sealing part 40. The exterior surface of the sealing part 40 is provided with a plurality of axially extending locating ridges 46, which are spaced so as to fit into gaps between adjacent cores of the stator 28, and a plurality of axially extending abutment ridges 48 which are located adjacent the partition plate 24 and which engage with the stator 28 to ensure that the stator is correctly aligned, radially and axially, with respect to the sealing part 40. The locating ridges 46 and abutment ridges 48 not only ensure that the stator 28 is correctly aligned, but also provide the sealing part 40 with structural stability without increasing the gap between the rotor 26 and the stator 28.

Whilst in this example, the location ridges 46 and abutment ridges 48 are regularly spaced around the sealing part 40, this need not be the case, and the ridges 46, 48 may be unevenly spaced on one or more of the ridges 46, 48 may be different to the others to ensure that the stator 28 can only be fitted in one particular orientation around the sealing part 40.

Once the stator 28 is in place, electrical connections between the stator 28 and the ECU 44 are completed, and the electrical filter 29 installed adjacent the stator 28. The motor housing 22 is then placed around the stator 28, the electrical connections between the ECU 44 and the external electrical connectors 25 are completed and the motor housing 22 bonded to the stator 28 using thermal adhesive. The motor housing 22 extends around partition plate 24, and a sealing element, in this example an O-ring, is located between the partition plate 24 and the motor housing 22 to substantially prevent ingress of dirt or moisture into the motor housing 22.

The rotor 26 and impeller 14 assembly is then inserted into the rotor chamber 41 and the collar part 38 placed around the static shaft 34 to prevent axial movement of the rotor 26 relative to the shaft.

Finally, an O-ring 50 is located in a groove around the outer circumference of the partition plate 24 and the volute 20 is mounted around the partition plate 24 such that the O-ring 50 provides a substantially fluid tight seal between the partition plate 24 and the volute 20. Attachment formations on the volute 20 are engaged with corresponding attachment formations on the motor housing 22 to retain the volute 20 on the pump assembly 10.

When used in this specification and claims, the terms "comprises" and "comprising" and variations thereof mean that the specified features, steps or integers are included. The terms are not to be interpreted to exclude the presence of other features, steps or components.

We claim:

1. A method of making a pump assembly including a pumping element mounted for rotation within a pump chamber, movement of the pumping element in the chamber causing pumping of fluid within the pump chamber, and a motor, the motor including a stator and a rotor which is connected to the pumping element such that activation of the motor causes movement of the pumping element and hence pumping of fluid within the pump chamber, there being a sealing assembly which permits fluid in the pumping chamber to flow around the rotor but which substantially prevents fluid from the pumping chamber from contacting the stator, the sealing assembly including a partition part which lies between the stator and the pumping chamber and a sealing part which lies between the stator and the rotor, wherein the method includes the steps of:

locating the partition part in a mould cavity; and, overmoulding the sealing part such that during the overmoulding process the sealing part is moulded onto and around an attachment portion of the partition part.

2. The method of claim 1 wherein the sealing part is made from a polymeric material.

3. The method according to claim 1 wherein the partition part is metallic.

4. The method according to claim 3 wherein the partition part is primarily made from cast aluminium.

5. The method according to claim 1 wherein the rotor extends through an aperture provided in the partition part to the pumping element, and the attachment portion of the partition part is generally tubular and extends from around the aperture axially of the rotor.

6. The method according to claim 5 wherein a free end of the attachment portion is provided with a plurality of axially extending castellations.

7. The method according to claim 5 wherein the attachment portion is provided with at least one circumferential groove.

8. The method according to claim 5 wherein the attachment portion defines radially inner and outer surfaces, the sealing part over-moulded onto the radially outer surface.

9. The method according to claim 8 wherein the attachment portion is provided with at least one circumferential groove formed in the radially outer surface of said attachment portion.

10. The method according to claim 1 wherein a joint between the sealing part and the partition part extends from a first side of the sealing assembly to a second side of the sealing assembly, the pumping chamber disposed on one of said first and second sides of said sealing assembly and the stator disposed on the other of said first and second sides of said sealing assembly.

11. The method according to claim 1 wherein the rotor is mounted on a shaft for rotation about the shaft, and the sealing part is over-moulded around the shaft.

12. The method according to claim 11 wherein the shaft is provided with a circumferential groove.

13. The method according to claim 1 wherein the sealing part is made from PPS.

* * * * *